United States Patent [19]

Cavalleri et al.

[11] Patent Number: 4,521,167

[45] Date of Patent: Jun. 4, 1985

[54] LOW FRICTIONAL LOSS ROTARY VANE GAS COMPRESSOR HAVING SUPERIOR LUBRICATION CHARACTERISTICS

[76] Inventors: Robert J. Cavalleri, 1605 Gran Via, Orlando, Fla. 32825; William E. Clark, 401 Hyder St., NE., Palm Bay, Fla. 32907

[21] Appl. No.: 483,178

[22] Filed: Apr. 8, 1983

Related U.S. Application Data

[63] Continuation-in-part of Ser. No. 272,754, Jun. 11, 1981, abandoned.

[51] Int. Cl.[3] ..... F04C 18/00; F04C 29/02

[52] U.S. Cl. ..... 418/82; 418/94; 418/99; 418/150; 418/268

[58] Field of Search ..... 418/82, 94, 97–99, 418/150, 236, 238, 259, 268, 91, 92, 93

[56] References Cited

U.S. PATENT DOCUMENTS

| | | | |
|---|---|---|---|
| 1,854,692 | 4/1932 | Cooper | 418/99 |
| 2,070,662 | 2/1937 | Johnson | 418/91 |
| 2,423,639 | 7/1947 | Czarnecki | 418/238 |
| 2,622,538 | 12/1952 | Vincent | 418/268 |
| 3,000,324 | 9/1961 | Rosaen | 418/268 |
| 3,820,924 | 6/1974 | Cassidy | 418/97 |
| 4,269,576 | 5/1981 | Shibuya | 418/97 |
| 4,410,305 | 10/1983 | Shank et al. | 418/150 |

FOREIGN PATENT DOCUMENTS

| | | | |
|---|---|---|---|
| 696398 | 10/1930 | France | 418/94 |
| 908088 | 8/1945 | France | 418/97 |
| 52-24308 | 2/1977 | Japan | 418/99 |
| 179923 | 7/1923 | United Kingdom | 418/150 |

*Primary Examiner*—John J. Vrablik

*Attorney, Agent, or Firm*—Julian C. Renfro

[57] ABSTRACT

A low frictional loss, rotary vane gas compressor utilizing a housing having a generally elliptical cavity therein, and a rotor disposed in the cavity, with the axis of rotation of the rotor being offset from the central axis of the cavity. The housing has an inlet passage and a discharge passage, each in contact with the cavity, with the rotor having a plurality of radial slots in equally spaced relation about its periphery. A slidable vane is disposed in each of these slots, with the outer tip of each vane being in close proximity to an inner stator wall that defines the outer boundary of the cavity. The vanes serve to define a plurality of chambers in the cavity, which chambers undergo significant volume changes as they move about the cavity during rotation of the rotor, the vanes thus cooperating with the inner stator wall to compress gas entering the inlet passage, such that as it leaves through the discharge passage, it is at a higher pressure. Means provide a film of lubricant on the inner stator wall, with the outer tips of the vanes each possessing a compound contour that interacts with the film of lubricant to effect a good seal with the inner stator wall, while minimizing friction.

9 Claims, 6 Drawing Figures

LOW FRICTIONAL LOSS ROTARY VANE GAS COMPRESSOR HAVING SUPERIOR LUBRICATION CHARACTERISTICS

RELATIONSHIP TO RELATED APPLICATION

This is a continuation-in-part of copending application Ser. No. 272,754 entitled "Constrained Floating Vane", which we filed June 11, 1981, now abandoned.

BACKGROUND OF THE INVENTION

In the past several decades, there has been an interest in sliding rotary vane gas compressors, the interest in these devices being attributable to several factors, including their basic simplicity, comparatively low installation cost, and relatively high volumetric displacement.

These devices have typically involved a rotor containing a plurality of generally radial slots, which slots are disposed in spaced relation about the periphery of the rotor. Such rotor is mounted on a shaft, and disposed in a housing having either a circular or an elliptically shaped cavity. A slidable vane is disposed in each such slot, with these vanes being caused to move outwardly under the influence of centrifugal force at such time as power is applied to the rotor shaft. The outer tips of these vanes are intended to contact the inner walls of the generally elliptically shaped stator cavity and make sealing contact therewith.

As is obvious, the combination of vanes and sidewall is such that a plurality of chambers are in effect defined in the stator cavity, which chambers are constantly changing their respectively configurations during rotor rotation. Thus, by providing an inlet in the stator at a location where a given chamber is enlarging, a charge of gas to be compressed can be taken in. Then, during continued rotation of the rotor, this charge of gas is thereafter compressed as the generally elliptically shaped sidewall causes the respective vanes to move inwardly, to decrease the chamber size. By placing one or more exit ports or discharge ports at the location where each chamber has been caused to become quite small, gas under relatively high pressure can be delivered.

Unfortunately, prior art rotary van gas compressors suffered from several distinct disadvantages, such as high power penalties, and rapid wear at the tips of the vanes because of high loading, this usually being accompanied by insufficient lubrication.

Accordingly, we have been motivated to provide a vastly superior rotary vane compressor design and lubrication arrangement such that frictional power consumed as a result of vane tip contact with the inner sidewall of the cavity is greatly decreased without any degradation of the gas seal that must exist between adjacent chambers defined by the vanes.

SUMMARY OF THIS INVENTION

In accordance with a preferred embodiment of our invention, we have provided means in the rotor at locations between the rotor slots, for injecting suitable quantities of liquid lubricant onto an elliptically shaped inner stator wall as to create a highly advantageous oil film, between each vane tip and the inner stator wall, which oil film is subsequently used in a hydrodynamic fashion to support the vane. Instead of continuously injecting fixed quantities of lubricant, we have evolved an arrangement whereby the amount of lubricant injected at a given location is determined by the pressure existing at that location. In that way, ample lubrication is assured where needed, whereas unnecessary amounts of lubrication can be prevented, with the result that our compressor will outlast and outperform the devices of the prior art.

Other significant aspects of our invention involve means to minimize the radial vane load due to a pressure imbalance between the vane base and vane tip. This reduced load decreases the load capacity requirements of the oil film, and constrains the vane from contacting the stator surface.

Significantly, we entirely eliminate the need for springs utilized to bias the vanes outwardly, in accordance with teachings such as set forth in the U.S. Patent to Cassidy, Pat. No. 3,820,924.

Additionally, we minimize wear and friction by a refinement of the tips of the vanes. We preferably utilize vane tips created by the use of three different radii, thus resulting in outstanding wear qualities as well as substantial minimization of friction.

It is therefore a principal object of our invention to provide a rotary vane compressor wherein the frictional power consumed from the engagement of the vane tips with the elliptically configured inner stator wall is reduced without degrading the gas seal this engagement provides between adjacent working cavities or chambers.

A further object of this invention is to provide a rotary vane compressor wherein the wear of the vane tips and stator is minimized, with the result that our compressor will perform satisfactorily for many years with minimum attention.

A still further object is to avoid mechanical vane restraint by the utilization of a fluid dynamic damper for each vane, thus to increase the mechanical life of the machine components, and to decrease cost.

Still another object of our invention is to provide a rotary vane compressor wherein lubrication of the vanes is easily and efficiently accomplished, and wherein the displacement of the compressor is large relative to its size and its number of vanes.

Yet still another object of our invention is to provide a rotary vane compressor wherein a pressure balance existing between the vane tip and the vane base is such that vane life as well as stator life is greatly extended.

Yet another object is to provide a compressor having vanes whose tips form a highly advantageous compound contour.

Other objects, features and advantages of this invention will be more apparent as the description proceeds.

DETAILED DESCRIPTION

Figure 1:
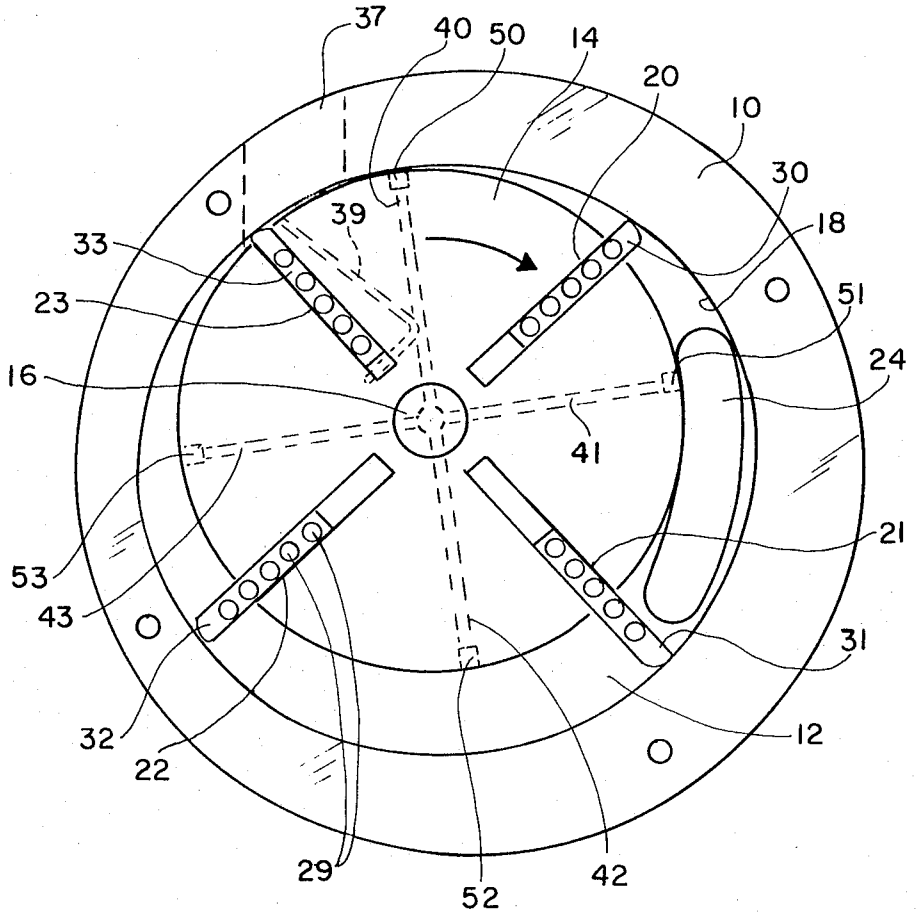
FIG. 1 is a cross sectional view of our novel compressor, taken so as to reveal the rotor, the elliptical cavity in which the rotor is disposed, and the sliding vanes of the rotor, the outer tips of which vanes are in close proximity to the inner stator wall of the elliptical cavity.

Referring to FIG. 1, we have there shown an exemplary version of our invention, involving a stator housing 10, in which is defined a generally elliptically shaped cavity 12. We use the term "generally elliptically" to include circular. Disposed in this cavity is a circular rotor 14, fixed upon a rotatable shaft 16. The rotor contains a plurality of slots disposed at spaced intervals about its periphery. In this preferred embodiment, we utilize four radially disposed slots, 20, 21, 22 and 23, in which are located slidably disposed vanes 30, 31, 32 and 33, respectively.

The inner stator wall 18 of the stator cavity is the surface contacted by the outer tips of the vanes during rotation of the rotor, and thus forms the outermost radial boundary for the gas that is to be pumped. The outer periphery of the rotor forms the innermost boundary, and the end plates 27 and 28, one located on each side of the stator housing 10, form the axial boundaries for the compressor. These end plates are best seen in FIG. 3, and they are held together in the proper working relationship by a series of bolts 19 passing through aligned holes in the end plates and the stator.

In this preferred embodiment, the device is configured as a single stage pump or compressor, and the geometric center of the rotor/shaft assembly is offset upward and to the left (for clockwise rotation) from the geometric center of the inner stator wall 18 of the cavity 12, as is conspicuous in FIG. 1. This offset is typically on the order of a few percent of the rotor radius, and is sufficient to cause a volume of gas entering through a suitable inlet port 24, and trapped between two adjacent vanes, to vary as the shaft is driven in rotation by a motive force (not shown).

Figure 3:
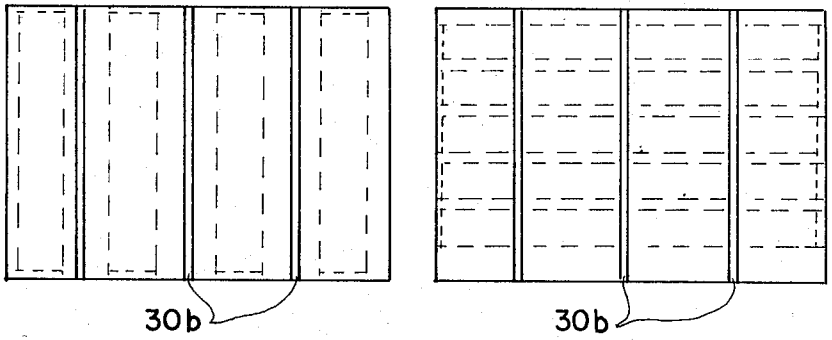
FIG. 3 is a cross sectional view taken along the length of the rotor shaft, with this view revealing the end walls of the compressor stator, as well as bearing and shaft details.
Figure 3:
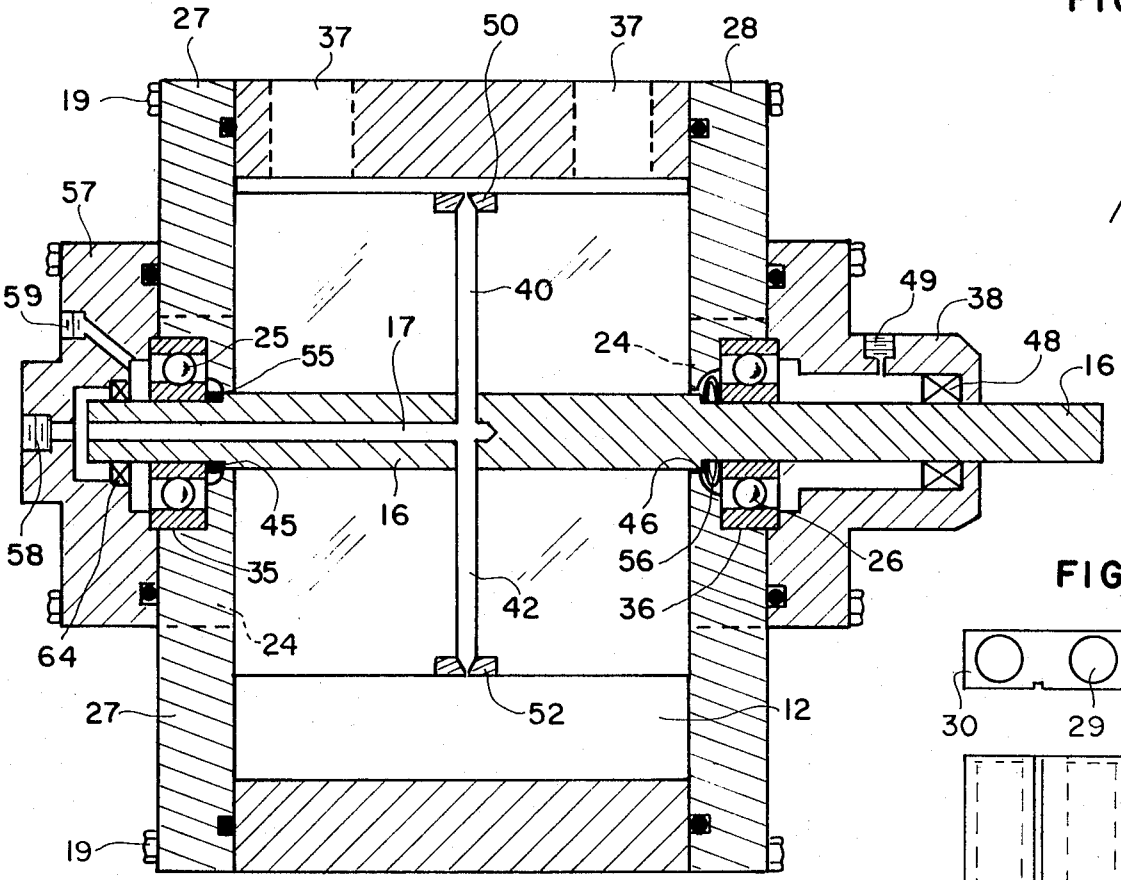

FIG. 1 reveals that each inlet port 24 may be created to extend for a substantial but nevertheless limited angular extent, and FIG. 3 reveals that two ports or passages 24 are preferred, one in each of the end plates 27 and 28. As the rotor 14 is driven in rotation, clockwise in this instance as viewed in FIG. 1, the vanes 30–33 are driven outwardly under the effect of centrifugal force, with the tips of the vanes in close proximity to the inner stator wall 18 of the cavity 12. We mean by the words "close proximity" that the vane tips are riding on a film of lubricant coating the inner stator wall 18.

Gas entering through inlet ports 24 is thereafter compressed during continued rotation, as the chambers defined by each adjacent pair of vanes are caused to diminish in volume, and ultimately the compressed gas exits from the cavity 12 through exit ports 37; see FIGS. 1 and 3. We prefer to use two inlet ports and two outlet ports, each of limited angular extent, but we are not to be limited to this number.

Figure 2:
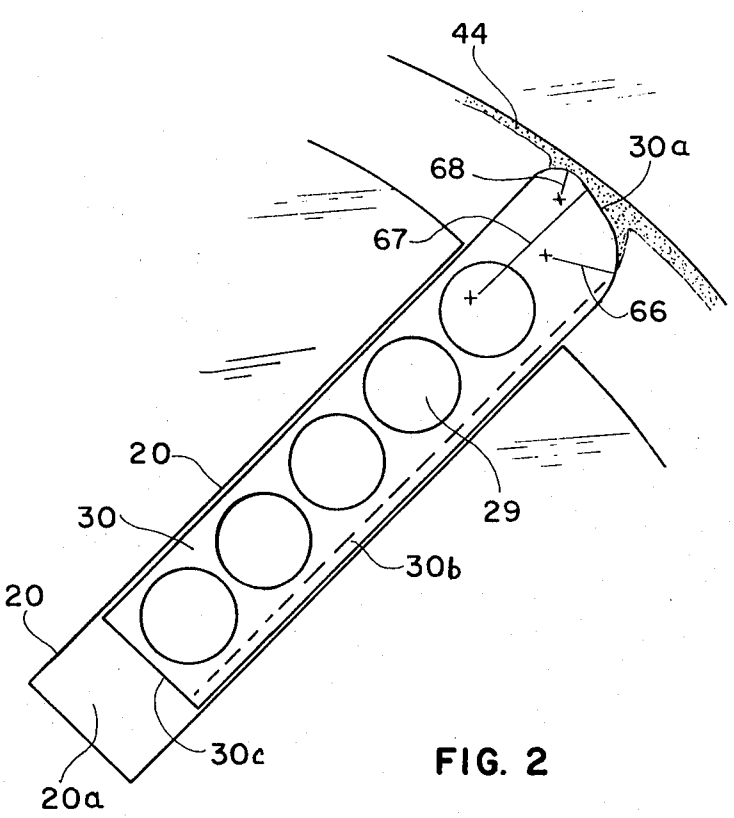
FIG. 2 is a view to a much larger scale of one of the vanes of FIG. 1, with this view showing a considerable amount of significant vane detail, and also illustrating the oil film generated in accordance with this invention.

As will be set forth at length hereinafter, we have made it possible to greatly lessen the wear of the vane tips, and therefore to enhance the output and efficiency of the pumping action that is achieved in accordance with this invention. FIG. 2 illustrates vane 30 to a larger scale, and its tip 30*a* is shown in considerable detail, as will hereinafter be discussed.

It will be apparent to those skilled in the art that during rotation of the rotor and shaft assembly, the vanes 30–33 are subjected to forces along their radial length, as a result of their own radial acceleration and radial pressure differences. In typical non-lubricated rotary vane compressors of the prior art, these forces cause the vanes to directly contact the stator housing inner wall. Such contact insured sealing against leakage between adjacent gas chambers, but it also had the unfortunate characteristic, in such prior art devices, of causing vane wear and/or stator wear, as well as substantial torque penalties due to frictional drag. In prior art lubricated rotary vane compressors, lubrication of the vane tip was generally a random occurrence, and was usually not sufficient to prohibit significant contact of each vane tip with the circumferential stator wall. This resulted in significantly reduced compressor life. Our objective in this invention is to have a compressor design that will function at a desired performance level for a period of nominally five years or longer, with minimal maintenance.

In contrast with the prior art, the present invention minimizes the frictional drag by effectively minimizing vane contact with the inner stator wall of the stator housing, around the entire inner periphery of the stator. This is done by forcing a liquid film between the tip of the vane and the stator housing inner wall. Note FIG. 2 at 44. The film acts hydrodynamically with the moving vane, serving as a bearing to constrain the vane and to reduce torque penalties significantly, in distinct contrast with the penalties associated with conventional rotary vane compressors. The hydrodynamic film is preferably composed of liquid oil so that the sealing between adjacent gas chambers is effective in preventing leakage, and wear of the vane tip and stator is also minimized.

The minimization of losses in the compressor depends on reducing the friction between the moving surfaces. As is well known, when a rotary vane compressor rotates, there is a centrifugal radial load generated by each vane, which load is supported by the stator, and is given by the standard equation $$F_c = m\left[r\omega^2 - \omega\left(\frac{dV_r}{d\theta}\right)\right]$$

where m = mass of the vane r = radial c.g. of vane $V_r$ = radial velocity of vane $\omega$ = angular rotation rate of rotor $(dV_r)/d\theta)$ = rate of change of $V_r$ with respect to angular location.

This force is minimized, in accordance with the present invention, by using lightened vanes. Lightening can be accomplished by using circular holes drilled through each vane, as shown in FIGS. 1 and 2 at 29, and in more detail in FIGS. 5*a* and 5*b*. Since all of the vanes 30–33 are alike, the characteristics of vane 30, illustrated in considerable detail in FIG. 2, may be regarded as applicable to all of the vanes we use in this compressor.

Figure 5B:
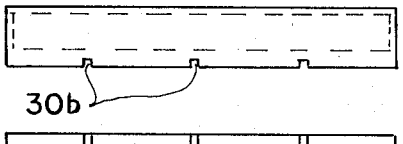
FIGS. 5*a* and 5*b* represent various ways in which the vanes can be lightened.
Figure 5A:
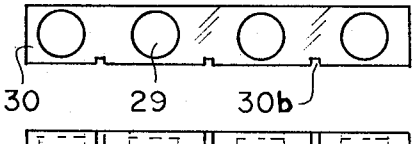

In FIG. 5*a*, the lightening holes are parallel to the vane face bleed passages 30*b*, whereas in FIG. 5*b*, the lightening holes are perpendicular to the passages 30*b*. In either instance, the lightening holes are blocked at each end, so as to permit no communication of compressed gas therethrough during compressor operation.

To prevent a lightened vane from being pushed away from the stator surface, such as by excessive pressure forces in the vicinity of the discharge port, the base of each vane must be suitably pressurized. We can accomplish pressurization in two ways. The first, as best seen in FIG. 2, is to use the bleed passages 30*b* of appropriate size in the vane leading face, which will result in pressuring the vane base 30*c*, located in vane slot or cavity 20*a*, as the chamber pressure increases. Note these passages in FIGS. 5*a* and 5*b*. Likewise, as the chamber pressure decreases after it passes the discharge port, the pressure in cavity 20*a* below the vane base will decrease. The end result is a pressure distribution at vane base 30*c*, that is in phase with the gas pressure at the vane tip 30*a*, thus amounting to an effective pressure balance.

Figure 4:
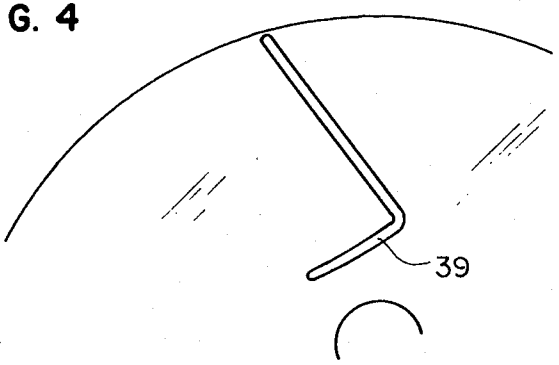
FIG. 4 is a showing of the interior surface of an end plate, this view revealing our novel end wall relief passage.

Additional leakage paths, known as end wall relief passages, may be provided in the end plates 27 and 28 to allow this gas to leave (or enter) the vane base region and be discharged (or supplied) into the suction port (or discharge port.) Note the exemplary end wall relief passage 39 in FIG. 1, which passage is more clearly shown in FIG. 4. This second technique utilizes the volume in space 20*a* below the vane base 30*c* as a chamber. The pressure in this latter chamber increases as the vane moves in, and decreases as the vane moves out. Excess pressure is discharged through the end wall relief passage 39, with one of these passages preferably being located in each end wall.

Thus, our lightweight vane minimizes the dynamic centrifugal vane load, and the pressure load is minimized through the use of internal bleed paths in either or both of the vane faces and the end walls. These combined effects result in reduced radial load and reduced friction. This also reduces the load capacity requirement of the hydrodynamic vane tip oil film. We can use the vane face bleed passges and omit the end wall relief passages, but typically these are used in concert. Also, there may be instances when end wall relief passages would be used when the vane face bleed passages have been omitted, but this is not typical.

Other devices with higher radial loads require higher load capacities, and higher load capacities require smaller gap heights since the load capacity is inversely proportional to the gap height squared. Thus, each prior art devices require smoother surface finishes, and cost more to manufacture.

The present invention effects a hydrodynamically constrained vane with a combination of proper oil placement and an adequate vane tip shape. As illustrated in FIGS. 1 and 2, the vane tip 30*a* is a non-pivoting, stationary type, making the vane and vane tip completely integral.

The shape of the vane tip 30*a*, best seen in FIG. 2, is of a geometry which results in an adequate hydrodynamic bearing film as the vane sweeps the full circumference of the stator inner stator wall 18. In practice, an adequate hydrodynamic film is considered to be one which maintains a small gap between the vane tip and the stator sidewall over a substantial majority of the full circumference of the inner stator wall 18, a typical example of such oil film being shown at 44 in FIG. 2. The shape of the tip 30*a* is determined analytically by the Reynolds' equation, which is common and well established in the art of hydrodynamic bearing design.

The tip has a compound surface composed of a forward or leading radius 66, a central radius 67, and a trailing radius 68, as shown in FIG. 2. The leading radius and the trailing radius are such that the vane does not contact the stator surface with a sharp edge, and these radii are smaller than the central radius. The central radius is selected to give good hydrodynamic load capacity for the vane tip. This radius is therefore large relative to the trailing and leading radii, and results in the vane central region being in close proximity to the inner stator wall 18. The tip geometry will be described at greater length hereinafter.

There are a number of structural configurations to effect proper oil placement for the hydrodynamic film, the example of which was illustrated at 44 in FIG. 2. One structure, as best shown in the exemplary vane illustrated in FIG. 2, consists of channeling oil to the vane tip 30*a* through the vane face bleed passages 30*b* located along the radial length of the vane. Oil is introduced into the cavity 20*a* formed in slot 20 below the base 30*c* of the vane 30, where it enters the metering passages 30*b*. Centrifugal force and pressure differences force the oil to the vane tip.

A second configuration consists of injecting oil into the suction gas stream. Centrifugal force acting on the oil droplets force the oil to the stator housing inner wall and under the vane tip in accordance with conventional practice.

A third and preferred configuration for applying controlled quantities of lubrication is through spray nozzles 50, 51, 52, and 53 located in the rotor as shown in FIGS. 1 and 3. These nozzles are attached at the outlets of oil passages 40, 41, 42, & 43 respectively, that are radially disposed in rotor 14, and each spray nozzle has a flat wide spray pattern that extends between both end plates 27 and 28. Oil is supplied to the oil passages and respective spray nozzles from a long axial passage 17 formed in rotor shaft 16, as best shown in FIG. 3. Each nozzle is located close enough to the respective vane leading edge in order that sufficient oil is maintained at the vane stator interface for hydrodynamic lubrication and for sealing.

The generally elliptical stator housing inner stator wall 18 thus effectively serves as a cam for the motion of the vanes. As such, the shape of the stator housing directly affects the loads the hydrodynamic bearing film 44 at the vane tip must support. In general, the less change in the radial distance from the center of the rotor to the stator housing wall, the less will be the variation in the centrifugal force component of the load support required of the vane tip hydrodynamic film as indicated by the equation term $dV_r/d\theta$. Further, the more uniform (or less variation) in the pressure loading, the more functional will be the selected shape for the vane tip over the entire inner periphery of the stator. Thus, the stator housing inner wall contour design compliments the design of a successful vane tip shape.

The configuration we use for the stator housing inner wall 18 serves to compliment the vane tip shape in a manner that minimizes variations in the hydrodynamic film loading, while maximizing the displacement and volume change of the compressor. This is accomplished with stator housing inner wall shapes that are circular perturbations, elliptical in nature.

Cavity 12 is generally non-circular, having a slightly elliptical bias value ranging between 0.0 and 0.1, where the bias "e" is defined as $$e = \frac{a}{b} - 1$$

where the term "a" is equal to the length of the major axis of cavity 12, and the term "b" is equal to the minor axis of cavity 12. The surface of our preferred cavity is explicitly defined by the mathematical expression $$\frac{x^2}{a^2} + \frac{y^2}{b^2} = 1$$

where the terms "x" and "y" are Cartesian coordinates of any point on the surface of inner stator wall 18 of the cavity 12, the center of the coordinate system being at the geometric center of the cavity 12. The purpose of the non-circular cavity profile we prefer is to provide a large compressor displacement and a large volume ratio, with a corresponding large pressure ratio compared to a conventional circular cavity profile.

The axial length of the rotor and the axial length of the stator housing are substantially equal except for a small clearance to allow free rotation of the rotor 14. The axial faces of the rotor are, therefore, in substantially close proximity with the end plates 27 and 28. In conventional rotary vane devices of similar size, the rotor is free to slide axially and contact the end plate. This contact causes drag and frictional losses resulting in a shaft torque penalty. It also causes wear of the rotor and end plates. In our invention, the rotor 14 is mechanically constrained in a highly advantageous manner from contacting either end plate, thus minimizing drag and frictional losses and minimizing wear of the rotor and end plates.

As previously mentioned, the rotor 14 is fixed upon shaft 16. The fixation may be accomplished by any suitable method, such as a press fit, for example. With reference to FIG. 3, the shaft 16 is mounted in ball bearing 25 in a bore 35 in end wall 27, and in ball bearing 26 in a bore 36 in the other wall 28. Further, one end of shaft 16 extends axially outward through a seal housing 38 attached to end wall 28, this attachment being obtained such as by the use of suitable bolts. We prefer to use seals, such as O-rings, at the juncture between each significant member of our compressor housing.

The seal housing 38 incorporates a seal 48 for the prevention of gas and lubricant leakage from the compressor, such seal being of any suitable type such as the mechanical face variety. The housing 38 contains a suitably threaded hole 49 for the injection of lubricant to seal 48, bearing 26, and the vane surfaces of vanes 30 through 33.

The shaft 16 is constructed such that its portion passing though the rotor 14 has a larger diameter than that portion passing through the bearings 25 and 26, thereby forming shoulders 45 and 46. A suitable spring 56 is positioned on the shaft 16 between the bearing 26 and the shaft shoulder 46. On the opposite end of shaft 16, a shim 55 is positioned between the bearing 25 and the shaft shoulder 45. The outer race of bearing 25 is tightly fitted in the bore 35 of end wall 27, thereby limiting the axial movement of said outer race. Additionally, the rear housing 57 may be so constructed to further secure the axial movement of said outer race of bearing 25.

Similarly, the outer race of bearing 26 is tightly fitted in the bore 36 of end wall 28, thereby limiting the axial movement of this outer race. Also, the front seal housing 38 may be so constructed to further secure the axial movement of the outer race of bearing 26. The inner bore of bearing 25 and the inner bore of bearing 26 are slightly loose fitting on shaft 16. Now, with the outer races of bearings 25 and 26 axially fixed, the shaft 16 and the rotor 14 thereto affixed become adjustable in an axial direction according to the thickness of shim 55. In general, the thickness of shim 55 is so sized to cause rotor 14 to be centered between the interiors of end walls 27 and 28, thereby eliminating undesired contact between the rotor 14 and the end walls during compressor operation.

The spring 56 is so sized to provide a sizeable outward axial load on the inner race of bearings 25 and 26, thereby removing any axial play which may have otherwise existed in the bearings. Thus, the axial position of the rotor and shaft assembly is positively fixed, and effectively constrained from axial displacement. It is understood that the above description is exemplary, and that modifications of the above technique for providing rotor axial restraint are possible in conjunction with our novel rotary vane compressor.

As previously mentioned, the shaft 16 contains a hole 17 concentric with the outer diameter of the shaft and extending axially for a substantial distance from the non-driven end of the shaft. The shaft 16 also contains a number of short radial holes which are mere extensions of radial holes or passages 40, 41, 42, and 43 contained in the rotor 14. In other words, latter radial holes intersect with the short holes disposed in shaft 16, which in turn connect to axial passage 17.

The rear seal housing 57 is attached to end wall 27, such as by the use of suitable bolts. Said housing contains a suitably threaded hole 58 aligning with shaft hole 17, the purpose of which is to provide an oil metering hole for lubricating oil to pass to the oil nozzles 50–53, previously mentioned. Housing 57 also contains a suitably threaded oil metering hole 59 for the purpose of injecting lubricant to bearing 25 and to the vanes. A seal 64 causes the two metering passages 58 and 59 to be isolated from each other, such that sufficient, but not excessive lubrication to the pertinent components can be assured.

As previously mentioned, the axis of rotation of rotor 14 is offset from the geometric center of gravity 12 such that the outer diameter of the rotor comes into close proximity with the inner stator wall 18; note FIG. 1. Clearance between the rotor and the wall 18 is sufficiently small as to create an effective gas seal between the suction and discharge sections of the compression chamber.

The vanes 30,31,32, & 33 are each of identical construction, so that a description for one will suffice for all. The vanes have a width substantially equal to the rotor 14, and a thickness substantially equal to that of the vane slots. Each vane has a tip edge portion at its outer radial end which is adapted to sealingly engage the curved inner stator wall 18 during its traverse of said surface.

More particularly, and as shown in conjunction with the exemplary vane 30 depicted in FIG. 2, the shape of the vane tip 30*a* we prefer is composed of three unequal, non-concentric radii, all blending to form a generally smooth and unbroken surface profile. The forward radius 66 and the trailing radius 68 are substantially smaller than the central radius 67, and their centers are located within the physical confines of the vane. The purpose of the forward radius 66 and the trailing radius 68 is to prevent contact of a sharp vane edge, such as might be present without said radii, with the inner stator wall 18. The magnitude of the central radius 67 is at least twice that of either of the other two said vane tip radii. Further, the central vane tip radius 67 will be sufficient duration in arc as to account for at least half of the vane tip circumference. The location of the center of the central vane tip radius is located nearer the trailing side of the vane than the leading side, but is not necessarily located within the physical confines of said vane. The purpose of the central vane radius 67 is to provide a bearing surface which will develop substantial hydrodynamic support for the vane, thereby minimizing material contact between the vane tip and the inner stator wall 18, and thus minimizing wear.

Quite significantly, our vanes 30, 31, 32 & 33 have one or more radial grooves or passages on their forward faces, in each instance extending the full radial length of the vane. These radial grooves, which correspond to grooves 30*b* in FIGS. 2, 5*a*, and 5*b*, are of sufficient cross section to allow unobstructed communication between the gas in the vane base and the gas in the compression chamber. Typically, three or so grooves or passages of rectangular or semi-circular cross section are utilized, but we obviously are not to be limited to this number. One purpose of these radial grooves is to provide an exit for gas that would otherwise be trapped within the vane slot and subsequently undergo compression, thereby creating excessive power penalties as well as excessive friction at the vane tips. In other words, we significantly reduce radial vane load by the use of the lightening holes and by using the radial grooves or passages in the obtaining of a suitable pressure balance across each vane.

A second purpose of these grooves is to make full use of the volume within the vane slot as a part of the gas compression process. Since the vane slot volume 20*a* is free to communicate with the compression chambers defined between each adjacent pair of vanes, said volume thereby increases the displacment of the compressor without changing the remaining compressor geometry or speed of operation. A third purpose of these grooves is to allow oil to flow from the vane base region to the vane tip region.

By sizing the grooves or passages correctly, an effective fluid dynamic damper is created. The grooves or passages must not have a total cross sectional area that is so large as would permit a vane to lift off of the oil film 44, or experience bounce. A base pressure merely sufficient to prevent vane bounce is what we achieve by our advantageous design.

As to the operation of our device, gas to be compressed is delivered to the compressor through the inlet passages 24. Presuming that the rotor 14 is being driven in a clockwise direction when viewed in FIG. 1, a low pressure is brought about in said inlets, and subsequently a flow of gas into cavity 12 takes place. When the tip of each vane passes the end of inlet ports or passages 24, the gas and any lubricant mixed therewith is trapped in the moving chamber formed by the end walls 27 and 28, the stator inner wall 18 of cavity 12, the outer surface of rotor 14, as well as the vane just passing said inlet ports or passages, and the next following vane. As this chamber becomes smaller in volume due to the rotation of the rotor, the gas becomes compressed.

Compression continues with the rotor rotation, until the leading vane of said chamber passes by the discharge passages 37. At this time, the compressed gas and lubricant mixture is pushed out of the compression chamber through the discharge passages 37 into any suitable manifold or collection tube.

The discharge passages or outlet ports 37 may each be equipped with a suitable reed valve, as is common practice, in which case the compressed gas and lubricant mixture will not exit the compression chamber until the pressure in said chamber has reached a level slightly exceeding that pressure level to which the compressor discharge is subjected.

As the rotor 14 is driven in rotation, the vanes 30–33, which are free to slide in their rotor slots 20–23 respectively, are urged outwardly by the centrifugal force acting thereon, and by the pressure of the compressed gas which is passed through the vane radial grooves. These forces are opposed by the hydrodynamic force created by the lubricant film 44 established between the inner stator surface 18 of cavity 12, and the contoured end surfaces of the vanes, the placement of said film being further described hereinafter.

The radial vane grooves corresponding to grooves 30*b* in FIGS. 2, 5*a* and 5*b* also function to effectively minimize the radial forces said hydrodynamic film must support by relieving excessive pressure that would otherwise build up from compression of the gases in the vane slot, as the vane moves inwardly into its rotor slot, thereby effecting a near balance in the gas pressures across the radial direction of the vane.

The elliptical profile of inner stator wall 18 and the contoured tip surfaces of the vanes are so matched as to maintain a sizeable radial hydrodynamic force at each vane tip, which is substantially maintained over the entire periphery of inner stator wall 18. Such hydrodynamic force minimizes friction losses and material wear, which normally occur in conventional rotary vane compressors.

The profile of inner stator wall 18 has other advantages not relating to said hydrodynamic support of the vanes. Such advantages include higher displacement and higher obtainable pressure ratio with a small diameter of vanes compared to conventional circular profiles. These advantages result solely from the geometric relationsips between the rotor 14, its offset, and the profile of inner stator wall 18, said combination creating a relatively large suction volume and a relatively small discharge volume, with said volume change occuring over a larger arc of rotation.

As the compressor is operated, lubricating oil is discharged with the compressed gas. It is understood that this lubricant is subsequently separated from said discharge gas by some means externally located to the compressor, such as by a conventional oil separator, and that such lubricant is subsequently returned to the compressor by connecting tubes suitably attached to the oil inlet passages 49, 58, and 59. Some oil may continue through the separator and not return to the compressor by said connecting tubes. In this case, it is assumed that this oil will eventually return to the compressor suction if the system in which the compressor is functioning is a closed system. If on the other hand, the system is an open one, it is assumed that the lubricant level in the separators will be replenished so that there is always a constant supply of oil to the oil passages 49, 58 and 59.

After passing through bearings 25 and 26, the lubricating oil inserted through the passages 49 and 59 then flows into the annular space formed by the shaft outer diameter and the shaft bores in the end walls 27 and 28. A portion of the oil then passes through the space bounded by the side of the rotor 14 and the end walls, forming an effective seal to prevent gas leakage therethrough. This oil portion then flows into the gas compression chamber where it is subsequently discharged, separated, and then returned to the inlet passages 49 and 59 for a repeat cycle. The remaining oil portions enter the vane slots 20–23, thereby lubricating the sliding portions of the vanes 30 through 33. These oil portions then flow into the gas compression chambers where they are discharged, separated, and then returned to the previously mentioned oil inlets.

It is to be noted that pressure inside the housings 38 and 57 is lower than the discharge gas pressure, causing lubricant to flow into these housings without the assistance of an external pump. It is to be understood that the threaded holes 49 and 59 may contain a suitable orifice to restrict the oil flow to a desired level. Also, it is possible within the spirit of our invention to be able to control the flow of the lubricant by means of a suitable valve.

As the compressor is operated, lubricating oil is directed into threaded hole 58 of housing 57, thereby entering shaft oil passage 17, and thereafter radial oil passages 40–43. It is to be noted that this oil is delivered in controlled quantities to the dispersion nozzles 50–53 without significant restriction. These nozzles break up the oil into small particles, spraying these particles in a desired pattern across the respective compression chamber, and onto the inner stator wall 18. We have found that a desirable spray pattern is one which is flat and wide, and thus suitable for causing a uniform film of oil to be deposited across the entire axial dimension of the wall 18. The most advantageous spray pattern is obtained by proper selection of the nozzle orifice geometry. Also to be noted is the fact that the nozzles 50–53 also function to meter the lubricating oil out at a desirable rate, such rate of flow being determined primarily by the size of each nozzle orifice, but such flow is cyclical, as will be explained shortly.

As a result of the lubricant being deposited on the inner stator wall 18, the vane tips subsequently pass over the lubricant film, thereby bringing about a hydrodynamic effect between vane tip contour and inner stator wall 18 that is quite advantageous. More specifically, the vane tips are caused to maintain a small distance away from the wall 18 of the cavity 12, which is sufficient to prevent material contact between the vane tips and the inner stator wall over the entire portion of its circumference. In that way, component wear and friction are both minimized.

The gap or distance between a given vane tip and the inner stator wall 18 varies along the circumference of the wall in accordance with the radial load placed upon it by the vane tip. This variation may be calculated in accordance with conventional hydrodynamic bearing theory. This gap is normally filled with oil, thereby causing an effective gas seal that serves to prevent leakage between adjacent compression chambers.

The flow of lubricating oil through any one nozzle is dependent upon the pressure difference across the nozzle, such difference being caused by the oil delivery pressure. The oil supply pressure is assumed to be substantially constant, and equal to the compressor discharge pressure and the pressure in the particular compression chamber in which the nozzle is located. Consequently, the flow of oil through a given nozzle will be cyclical but repetitive during each revolution of the rotor 14. This transient flow pattern is affected by increasing chamber pressure as a chamber moves from the compressor suction region to the compressor discharge region, as a consequence of which, the oil flow decreases. Then, as the nozzle passes from the discharge region back to the region of the inlet passages 24, the oil flow is then increased.

These cyclical changes in oil flow are desirable in our invention inasmuch as the circumferential portion of cavity 12 receiving the maximum quantity of lubricant coincides with the regions of the cavity subject to maximum radial vane loads. These regions generally involve the suction portion (inlet passage area) of the cavity 12. Additionally, the circumferential portion of the cavity receiving the minimum quantity of lubricant coincides with the region of the cavity subject to minimum radial loads generated by each vane, with this region generally comprising the discharge portion 37 of cavity 12. Thus, it is quite accurate to state that the means for supplying lubricant to the vane tips is consistent with varying load requirements of the hydrodynamic film located between the vane tips and the inner stator wall 18, and that the flow of lubricant from each nozzle 50–53 is intrinsically metered as a function of the angular position of the respective radial oil passage with regard to the location of the inlet passage area of our compressor.

Our novel means of providing compressor lubrication have other, more subtle advantages. For example, precise placement of lubricant is automatically effected, thereby minimizing the random variations associated with prior art lubrication techniques. Also, the creation of lubricating films in accordance with our invention significantly reduces the quantity of lubricant required to be circulated through the compressor, thereby reducing oil contamination of the discharged gas, and also reducing the fouling of system components that may be attached to the compressor discharge.

We claim:

1. A low frictional loss, rotary vane gas compressor utilizing a housing having a generally elliptical cavity therein, and a rotor disposed in said cavity, with the axis of rotation of said rotor being offset from the central axis of said cavity, said housing having an inlet passage and a discharge passage, each in contact with said cavity, said rotor having a plurality of radial slots in equally spaced relation about its periphery, a slidable vane of minimal weight being disposed in each of said slots, with the outer tip of each vane being in close proximity to an inner stator wall that defines the outer boundary of said cavity, said vanes serving to define a plurality of chambers in said cavity, which chambers undergo significant volume changes as they move about said cavity during rotation of said rotor, said vanes thus cooperating with said inner stator wall to compress gas entering said inlet passage, such that the gas thereafter leaving through said discharge passage is at a higher pressure, means for providing a film of lubricant on said inner stator wall, latter means including the use of a plurality of radial passages defined in said rotor, with a metering nozzle located on the outer end of each such radial passage, such that the quantity and dispersion of the lubricant flow therefrom will be controlled in a desired manner, the outer tips of said vanes each possessing a compound contour that interacts with such film of lubricant to effect a good seal with said inner stator wall, while minimizing friction.

2. The rotary vane gas compressor as defined in claim 1 in which at least one vane face relief passage is disposed on the forward face of each vane, to enable communication between the base of each vane residing in a respective radial slot of said rotor, and the chamber in which the forward face of said vane is disposed.

3. The rotary vane gas compressor as defined in claim 1 in which said housing involves an end wall disposed on each axial end of said rotor, with the side edges of each vane being in sealing but movable contact with the interior portion of each end wall during rotor rotation, at least one of such interior end wall portions being equipped with an end wall relief passage, to enable communication at certain rotative positions, between the base of each vane residing in a respective radial slot of said rotor, and the chamber in which the forward face of said vane is disposed.

4. The rotary vane gas compressor as defined in claim 3 in which at least one vane face relief passage is disposed on the forward face of each vane, to enable continuous communication between the base of each vane residing in a respective radial slot of said rotor, and the chamber in which the forward face of said vane is disposed.

5. A low frictional loss, rotary vane gas compressor utilizing a housing having a generally elliptical cavity therein, and a rotor disposed on a shaft assembly in said cavity, with the axis of rotation of said rotor and shaft assembly being offset from the central axis of said cavity, said housing having an inlet passage and a discharge passage, each of a limited rotational extent, and each in contact with said cavity, said rotor having a plurality of radial slots in equally spaced relation about its periphery, a slidable vane of minimal weight being disposed in each of said slots, with the outer tip of each vane being in close proximity to an inner stator wall that defines the outer boundary of said cavity, said vanes serving to define a plurality of chambers in said cavity, which chambers undergo significant volume changes as they move about said cavity during rotation of said rotor, said vanes thus cooperating with said inner stator wall to compress gas entering said inlet passage, such that the gas thereafter leaving through said discharge passage is at a higher pressure, means for providing a film of lubricant on said inner stator wall, latter means including the user of a plurality of radial passages defined in said rotor, with a metering nozzle located on the outer end of each such radial passage, such that the quantity and dispersion of the lubricant therefrom will be controlled in a desired manner, the outer tips of said vanes each possessing a compound contour that interacts with such film of lubricant to effect a good seal with said inner stator wall while minimizing friction, and means for constraining said rotor and shaft assembly from axial displacement.

6. The rotary vane gas compressor as defined in claim 5 in which means are provided for establishing communication between the base of each vane and the chamber in which the forward face of the vane is disposed, said means for establishing communication involving the use of at least one radial slot located on the forward face of each vane.

7. The rotary vane gas compressor as defined in claim 5 in which said housing involves an end wall disposed on each axial end of said rotor, with the side edges of each vane being in sealing contact with the interior portion of each end wall during rotor rotation, wherein said means for establishing communication involves the interior of at least one of such end wall portions being equipped with an end wall relief passage such that at certain rotative positions, communication is established between each vane base, and the chamber in which the forward face of the vane is disposed.

8. The rotary vane gas compressor as defined in claim 7 in which additional communication between the base of each vane and the chamber in which the forward face of said vane is disposed, is furnished by at least one radial slot located on the forward face of each vane.

9. A low frictional loss, rotary vane gas compressor utilizing a housing having a generally elliptical cavity therein, said cavity being defined by the Equation $$\frac{x^2}{a^2} + \frac{y^2}{b^2} = 1$$

and further the quantity (a/b)−1 being limited to between 0.0 and 0.1, a rotor disposed in said cavity, with the axis of rotation of said rotor being offset from the central axis of said cavity, said housing having an inlet passage and a discharge passage, each in contact with said cavity, said rotor having a plurality of radial slots in equally spaced relation about its periphery, a slidable vane of minimal weight being disposed in each of said slots, with the outer tip of each vane being in close proximity to an inner stator wall that defines the outer boundary of said cavity, said vanes serving to define a plurality of chambers in said cavity, which chambers undergo significant volume changes as they move about said cavity during rotation of said rotor, said vanes thus cooperating with said inner stator wall to compress gas entering said inlet passage, such that the gas thereafter leaving through said discharge passage is at a higher pressure, means for providing a film of lubricant on said inner stator wall, latter means including the use of a plurality of radial passages defined in said rotor, with a metering nozzle located on the outer end of each such radial passage, such that the quantity and dispersion of the lubricant flow therefrom will be controlled in a desired manner, the outer tips of said vanes each possessing a compound contour composed of at least two unequal, non-concentric radii, the magnitude of the largest radius being at least twice that of any other radius, and with the center of such largest radius being located nearer the trailing side than the leading side of said vane, but not necessarily located within the physical confines of said vane, the center of any other radius being located within the physical confines of said vane, the outer tips of said vanes interacting with such film of lubricant to effect a good seal with said inner stator wall while minimizing friction.

* * * * *